US010724833B1

(12) United States Patent
Bowmar

(10) Patent No.: US 10,724,833 B1
(45) Date of Patent: Jul. 28, 2020

(54) DISMEMBERABLE TARGET ASSEMBLY

(71) Applicant: Joshua Todd Bowmar, Westerville, OH (US)

(72) Inventor: Joshua Todd Bowmar, Westerville, OH (US)

( * ) Notice: Subject to any disclaimer, the term of this patent is extended or adjusted under 35 U.S.C. 154(b) by 0 days.

(21) Appl. No.: 16/430,361

(22) Filed: Jun. 3, 2019

Related U.S. Application Data

(60) Provisional application No. 62/794,579, filed on Jan. 19, 2019.

(51) Int. Cl.
*F41J 7/04* (2006.01)
*F41J 1/01* (2006.01)

(52) U.S. Cl.
CPC ... *F41J 7/04* (2013.01); *F41J 1/01* (2013.01)

(58) Field of Classification Search
CPC ... F41J 7/04; A63F 9/02–0204; A63F 9/0243; A63H 33/046; A63H 3/16; A63H 3/46
USPC ..... 273/379–380, 383, 386–388, 393
See application file for complete search history.

(56) References Cited

U.S. PATENT DOCUMENTS 355,976 A * 1/1887 Crandall ..... A63F 9/02 273/334
1,277,702 A * 9/1918 Des Combes ..... F41J 5/26 273/380
1,536,436 A * 5/1925 Kolinski ..... F41J 7/04 273/393
1,579,004 A * 3/1926 Kolinski ..... A63F 9/0204 273/393
3,817,528 A * 6/1974 Stuhler ..... F41J 1/10 273/393

(Continued)

FOREIGN PATENT DOCUMENTS

GB 1256012 A * 12/1971 ..... F41J 5/20
GB 1256012 A 12/1971

(Continued)

OTHER PUBLICATIONS

"Sport Squad Bullseye Bash Magnetic Target Practice Game—Perfect Nerf Target for Shooting Practice—Includes Bow and Arrow for Kids and Flying Discs—Archery Toy Set for Boys and Girls" https://www.amazon.com/Sport-Squad-Bullseye-Magnetic-Practice/dp/B07HJQPFRX.

(Continued)

*Primary Examiner* — Laura Davison

(57) ABSTRACT

A dismemberable target for projectile sports includes a central component comprising magnets and detachable components also comprising magnets such that linear or branching arrays of detachable components may be assembled onto the central component.

Detachable components may be magnetically detachable while being attached by lengths of cord so that when detached by projectile impact they remain in close proximity for ease of reassembly, and also so that a struck and detached component may drop and swing from the component to which it is tied.

In particular embodiment, a dismemberable target is fashioned to look like a zombie or monster which may be sequentially dismembered by projectile shots. In other embodiments, target bodies or detachable components thereof may be fashioned to look like animals or a detachable assembly which resemble an animal, zombie, or monster.

11 Claims, 4 Drawing Sheets

(56) References Cited

U.S. PATENT DOCUMENTS

| | | | | | |
|---|---|---|---|---|---|
| 4,332,390 | A * | 6/1982 | Bury | F41J 5/00 | 273/384 |
| 5,443,073 | A * | 8/1995 | Wang | A61B 5/04012 | 600/526 |
| 6,893,315 | B2 * | 5/2005 | Barri | A63H 3/46 | 446/376 |
| 7,575,496 | B2 * | 8/2009 | Lau | A63H 3/20 | 446/308 |
| 9,039,584 | B2 * | 5/2015 | Chiang | A63B 69/004 | 482/83 |
| 2005/0170739 | A1 * | 8/2005 | Zoellner | A63H 3/16 | 446/92 |
| 2006/0105861 | A1 * | 5/2006 | Yang | A63B 57/10 | 473/396 |
| 2018/0093154 | A1 | 4/2018 | Kim | | |
| 2018/0250604 | A1 * | 9/2018 | Keesee, Jr. | A63H 33/003 | |

FOREIGN PATENT DOCUMENTS

| | | | | |
|---|---|---|---|---|
| GB | 2249033 | A * | 4/1992 | A63B 69/004 |
| GB | 2249033 | A | 4/1992 | |
| KR | 101484772 | B1 | 6/2014 | |
| KR | 101484772 | B1 * | 1/2015 | A63F 13/837 |

OTHER PUBLICATIONS

"Magnetic Knockdown Pellet Catcher Shooting Target Zombie Design" www.akdtrading.com/product/magnetic-knockdown-pellet-catcher-4-1-targets-zombie-design/.

* cited by examiner

DISMEMBERABLE TARGET ASSEMBLY

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

CROSS REFERENCE TO RELATED APPLICATION

This application claims the benefit of and priority to U.S. Provisional Application 62/794,579, "Dismemberable Target Assembly," filed 19 Jan. 2019. The entire contents of U.S. Provisional Application 62/794,579, "Dismemberable Target Assembly" are hereby incorporated into this document by reference.

FIELD

The invention relates to recreational targets for archery and other projectile sports.

BACKGROUND

Most targets for archery and other projectile sports are static objects that present non-reactive or non-moving surfaces or masses.

Some targets or portions thereof are designed to be displaced by projectile impact so that an effective or scorable hit may be easily observed from a distance.

BRIEF DESCRIPTION

Many people enjoy the challenges of projectile sport shooting such as archery, riflery, and other sports and games comprising striking a goal object with a thrown or flying object, or a missile propelled by a device.

In some sports points are awarded for strikes or hits on distinct portions of a target, often based on progressively smaller regions or other aspects such that more points are awarded for hits which require or demonstrate greater accuracy or shooting skills.

People who enjoy target sports often prefer reactive targets over static targets which merely absorb a projectile or allow it to pass through with little visual effect. Thus there are many sporting games and devices therefor which involve displacing a portion of a target, such as knocking over a moveable member of a target.

It is therefore a primary objective of the invention to offer a novelty target in which components are detachably assembled so that effective strikes may be seen to dismember the target assembly. A corollary objective of the invention is to offer a target which may be selectively or sequentially dismembered as part of a shooting game. Another corollary objective of the invention is to offer a dismemberable target assembly in which assembled members remain assembled unless a certain minimum ballistic energy is absorbed into them by a projectile hit, so that weaker or glancing hits fail to separate one component from another and may be discounted in a scoring system of a competitive game.

Target assemblies which include a central core or frame with other parts that come apart therefrom when struck may allow these parts to be undesirably displaced far afield from the central core or frame, such that they may end up lost or so that much time is spent seeking and retrieving the detached parts. Therefore another objective of the invention is to retain the detachable parts within an immediate vicinity of the central core or frame, so that a dismembered target may be easily and readily reassembled for its next use.

Yet another objective of the invention is offer a target bearing a visual image that shooters will enjoy hitting. Many people enjoy horror or paranormal fiction and may enjoy shooting at images depicting or reminiscent of fictitious characters such as zombies, ogres, vampires, orcs, and other creatures, and another corollary objective of the invention is to react in a manner visually reminiscent of wounding or dismembering a monstrous or horrific creature.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

DETAILED DESCRIPTION OF CERTAIN EMBODIMENTS

Figure 1A:
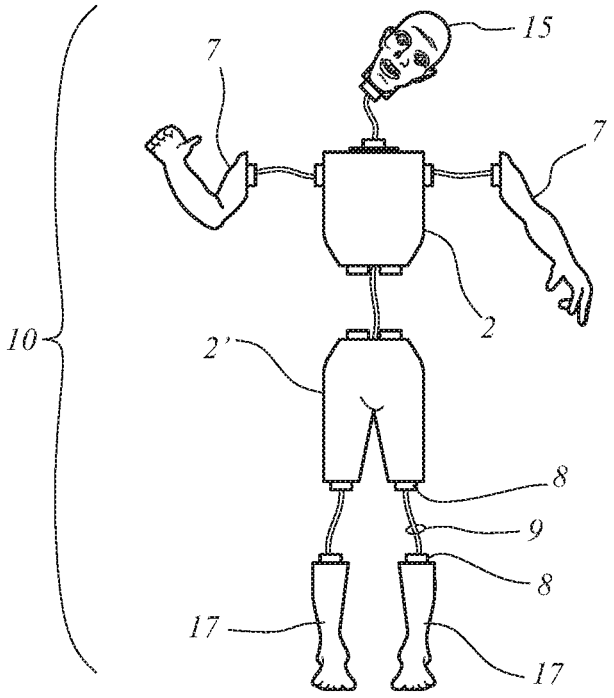
FIG. 1A shows an front view of embodiment of a dismemberable target assembly in accordance with the invention, in a dismembered state.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this application the use of the singular includes the plural unless specifically stated otherwise, and use of the terms "and" and "or" is equivalent to "and/or," also referred to as "non-exclusive or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

The invention is a dismemberable target which in some embodiments is configured for archery shooters but which may in other embodiments be configured for other ballistic projectiles or missiles which may be flung by hand or propelled by a device. In this specification the verb "shoot" and its related forms "shot," "shooting," et cetera encompass the various acts of directing generally unguided objects to impact upon a target or a preferred portion thereof. Projectile objects for use with the invention therefore include arrows, bullets, pellets, balls, sports objects, flying discs and flying rings, and makeshift objects such as naturally occurring rocks flung by hand. The word "shooter" includes any user interacting with a target by engaging in acts of directing objects, projectiles, or missiles to impact upon a target.

The target is an assembly of components which may be separated from each other when certain parts are struck by projectiles, including those which may embed themselves into the target component, such as arrows, darts, pellets, or bullets. The components may be shaped and decorated so that the target assembly resembles an animal or a humanoid target such as a zombie, ogre, robber, villain, terrorist, vampire, werewolf, were-creature, demon, dhampyre, or an alien. Preferred embodiments include bipedal creatures having a detachable head.

The components include magnets at various sites so that they may stick to each other by magnetic attraction. One set of preferred arrangements includes a main body or core mounted on a stand or a post, with magnet sites where proximal portions of limbs may be affixed and held by the magnetic force. Other sites on a central core component may have magnetic sites for affixing a head, wings, a tail, or accessories such as pieces of armor, a shield, a crest, or equipment such as a depiction of a weapon, ammunition pouches, a shield, or "magical" items or other items of value or significance carried by a fictitious or fantasy personage or creature.

Magnets hold components of the target together so they may be shot off and replaced onto the main body. Some components may incorporate steel or a ferrous metal so they may be held by other components which have magnets. Devices comprising magnetic projectiles which stick to metallic targets are outside the scope of the invention.

In addition to magnetic attraction force, components may also be temporarily or permanently tied together using lengths of rope or cords. In this specification the word "rope" will include all manner of flexible attachment members and materials such as rope, solid or multi-strand wire, chain, straps, tape, or cords.

An attachment site on a target component for a rope may include stitching such as an overlock stitch or stitching which passes through the rope and into material of the target component. Alternatively, a rope attachment site on a target component may include an aperture leading into a cavity within the target component, with a rope passing through the aperture and a knot in the rope which resides within the cavity. The knot may be a stop knot made larger than the aperture so that the rope cannot be pulled out. Alternatively, the material in the vicinity of the aperture may be elastic or compressible enough so that the weight of a dangling component is not enough to pull out the knot, but a stronger pull may extract the knotted rope without damage to the material around the aperture. Similarly, the material at a rope attachment site is selected to withstand insertion force used to install a knotted end of rope into a cavity by passing it through such an aperture. In this kind of embodiment the target components may be disconnected periodically and rearranged.

Thus an alternative embodiment within the scope of the invention is a is a dismemberable target assembly in which a main body further comprises a first aperture communicating with a first internal cavity, with the first detachable component further comprises a second aperture communicating with a second internal cavity. A rope passing through said first aperture of said main body and may also pass through the second aperture of said first detachable component. To prevent the rope from pulling out except when it is desired to rearrange to components, the rope may further comprise a stop knot at each of its ends.

Closed-cell foam and open cell foam may be used to make target components of the invention. While many sorts of archery and rifle targets are images or graphic elements printed on two-dimensional media, another distinction of the invention over typical targets is that a target in accordance with the invention may be a three-dimensional form in which target components are built up of three-dimensional solids which may be arranged so that they extend from the main body in any direction. In most lighting conditions, three dimensional solids will acquire light and shadows on them and in turn cast more realistic shadows around them than will arrangements of two-dimensional components. Some shooters find realistic looking targets to be more entertaining to shoot at.

A particular class of embodiments within the scope of the invention is a zombie target wherein all of target components representing its limbs and head may be shot off and reattached to its body by the use of magnets.

A head may be magnetized to affix to a torso of a body or a main body, and when an archer shoots the zombie in the head, the force will knock the head off providing fun and entertainment for the shooter. Thereafter a shooter or user need simply reattach the head back to its original position. The magnets will hold the head and other affixed components in place. Arms legs, limbs and tails may be built up of generally longitudinal components having magnets at or near their ends so that long appendages may be built up from a number of segments. Every element of the target may be shot and dismembered and put back together.

A particular disadvantage arises with dismemberable targets when shot at by arrows, quills, or bolts. These projectiles include fletching which may be delicate or easily damaged. If otherwise unrestrained, a dismemberable component could take an arrow, retaining it while separating from the rest of the target. The component having the arrow stuck in it accelerates in freefall and may be very likely to roll once it hits the ground until stopped by the protruding arrow like a wheel chock. The arrow protrudes from the center of rotation of the rolling component, and by angular velocity the end where the fletches are is moving the fastest, so when it hits the ground undesirable damage to the fletching is very likely.

Similarly, if a dismembered component with an arrow stuck in it tumbles in flight so that the protruding end of arrow is the first portion to hit the ground, that portion of the arrow is where the fletches are, and the fletching may take the full damage of stopping the combined mass of the arrow plus the dismembered object in motion.

By connecting dismemberable components of a target assembly by segments of rope, which for example may be limited in length to a foot or less, then a component dismembered by a shot will dangle nearby to its attachment site on the next connected component or the main body if it is attached there. An arrow retained in the dangling component is thus prevented from striking the ground in a manner which would risk damaging its delicate fletching.

Referring now to the figures, FIG. 1A shows an front view of embodiment of a dismemberable target assembly [10] in accordance with the invention, in a dismembered state. A main body or core [2] affords attachments for two arms [7] and a head [15.] A lower torso section [2'] supports the main body above, and it affords attachment sites for two lower legs [17.] Each junction between one component and another has at least one magnet [8] and a rope [9] attaching one component to the next.

Figure 1B:
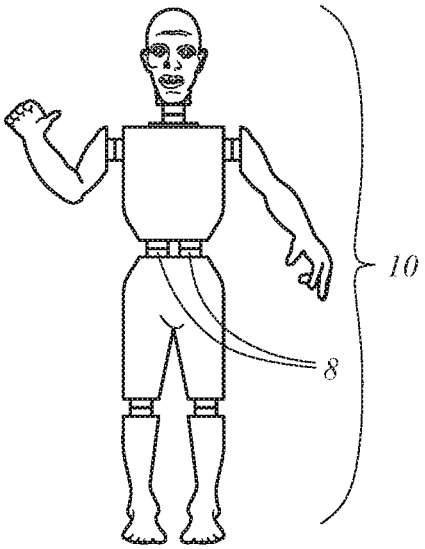
FIG. 1B shows front view of an embodiment of a dismemberable target assembly in accordance with the invention, in an assembled state.

FIG. 1B shows front view of an embodiment of a dismemberable target assembly in accordance with the invention in an assembled state. In this embodiment a single junction such as between the main body and the lower torso has more than one set of joined magnets [8.] Having one component affix to another by means of more than one pair of magnets may increase the projectile impulse required to separate the components. This behavior may mimic a critical and possibly high-score portion of the creature represented by the target or a portion of such a creature which is of heavier constitution and must be struck harder to be overcome.

Figure 1C:
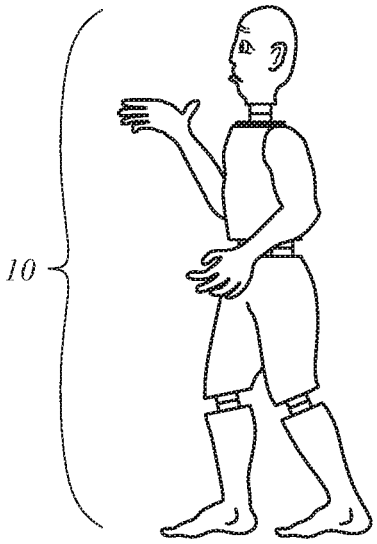
FIG. 1C shows a left-side view of an embodiment of a dismemberable target assembly in accordance with the invention.
Figure 1D:
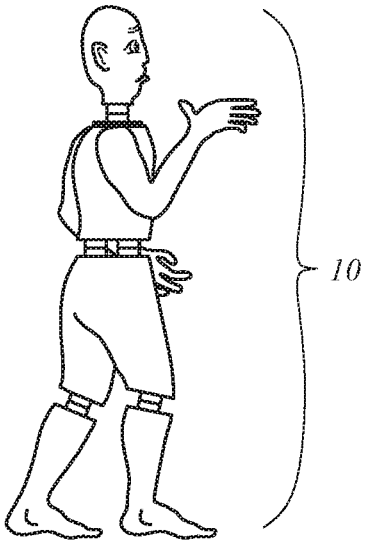
FIG. 1D shows a right-side view of an embodiment of a dismemberable target assembly in accordance with the invention.

FIG. 1C shows a left-side view of an embodiment of a dismemberable target assembly in accordance with the invention, and FIG. 1D shows a right-side view of an embodiment of a dismemberable target assembly in accordance with the invention.

Figure 2:
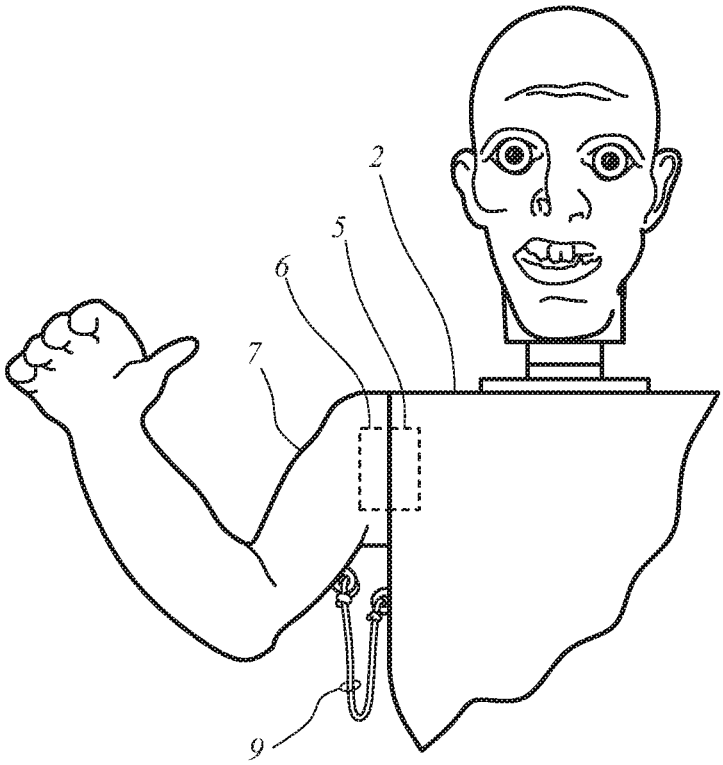
FIG. 2 shows a portion of an alternative embodiment of a dismemberable target assembly in accordance with the invention.

FIG. 2 shows a portion of an alternative embodiment of a dismemberable target assembly in accordance with the invention. This figure depicts how a rope [9] may be anchored elsewhere than where a dismemberable limb [7] affixes onto a main body [2.] A first magnet [5] on the main body attracts and retains a second magnet [6] on a dismemberable component affixed to it.

Figure 3A:
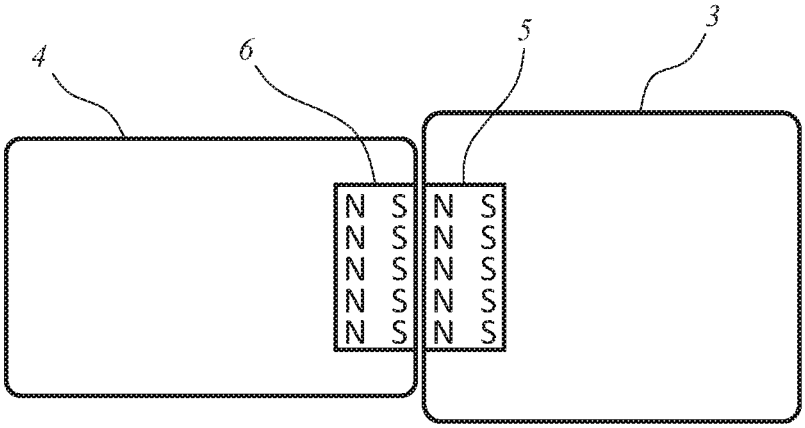
FIG. 3A shows a magnetic attachment means in accordance with the invention.
Figure 3B:
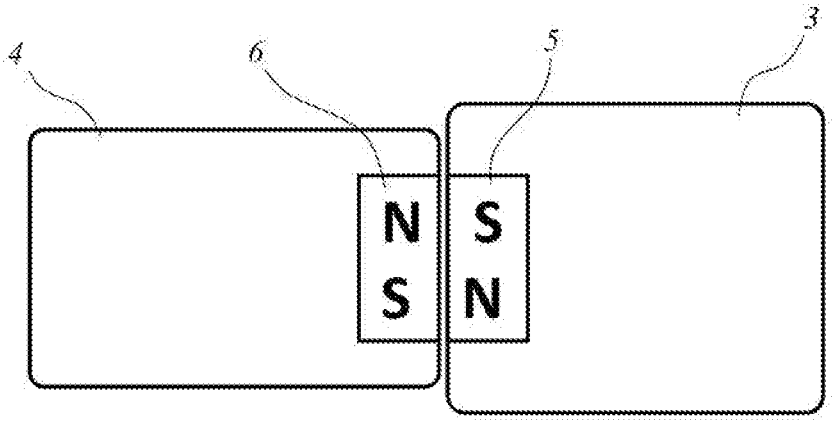
FIG. 3B shows an alternative magnetic attachment means in accordance with the invention.

FIG. 3A shows a magnetic attachment means in accordance with the invention. Magnets are available in many different shapes and options for how the magnetic poles are oriented within the body of the magnet. FIG. 3A shows a proximal component [3] having a first magnet [5] and a distal component [4] having a second magnet [6.] In this arrangement the north-south axes of the magnets are parallel to the longitudinal axes of the target components. FIG. 3B shows an alternative magnetic attachment means in accordance with the invention. Like in FIG. 3A, in this arrangement a proximal component [3] has a first magnet [5] and a distal component [4] has a second magnet [6.] However, in this arrangement the north-south axes of the magnets are transverse to the longitudinal axes of the target components. In this arrangement the two magnets may be bar magnets.

Figure 4:
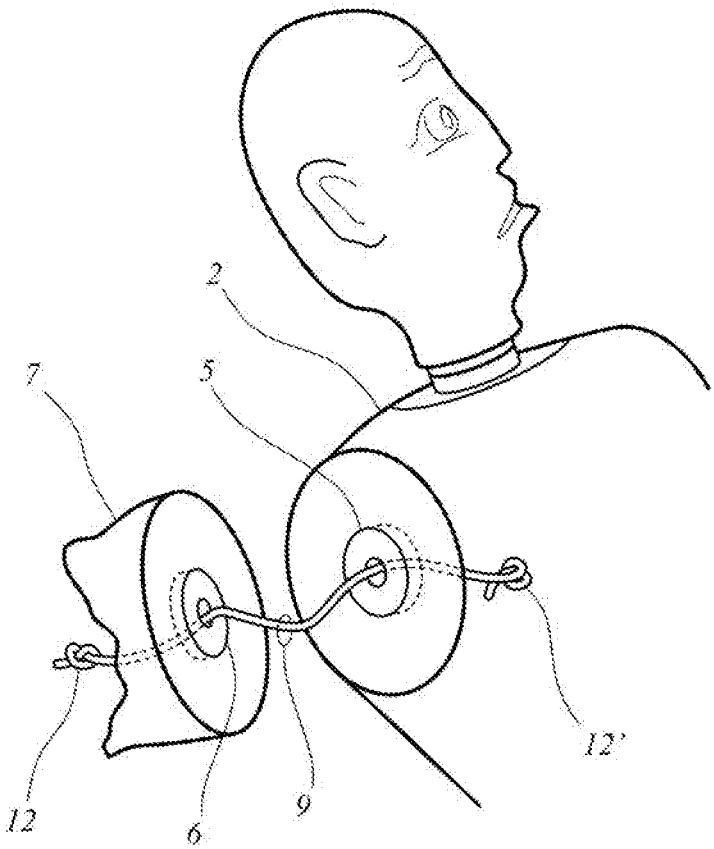
FIG. 4 shows another alternative embodiment of a nose bead in accordance with the invention.

FIG. 4 shows another alternative embodiment of a nose bead in accordance with the invention. In this arrangement a main body component [2] has a plurality of magnets which define attachment sites for detachable components, and also including a first magnet [5] and a first dismemberable or detachable component [7] which has a second magnet [6] or may also include a material attractable by magnetism. The magnets in this portion of the embodiment shown are ring-shaped magnets. The two target components are also attached together by a rope [9] which resides in an inner cavity of each component. Each component has an aperture which communicates with the inner cavity, and the ring magnet is deposited so as to surround the aperture. The rope is preferably sized to be close to the aperture of the ring magnet and the aperture of the component which leads to the inner cavity. Each end of the rope has a stop knot, also called a stopper knot, which may be any knot which creates a fixed thicker point on an otherwise uniform thickness of rope for the purpose of preventing the rope from slipping out of a narrow passage. Stop knots may be an overhand knot [12,] a double overhand knot [12'] a figure-eight knot, a stevedore knot, a monkey tail or monkey fist, a button knot or an Ashley stopper knot.

Thus in an alternative embodiment in accordance with the invention, the diameter of a first aperture in a detachable component or a main body is larger than the diameter of the rope passing through it, and the diameter of a stop knot is made larger than the diameter of the first aperture in the detachable component or main body. The diameter of a second aperture on the first detachable component is also made larger than the diameter of said rope, and the diameter of another stop knot is made larger than the diameter of the second aperture of said first detachable component. The inner cavity of the main body contains a stop knot made in the rope, and an inner cavity of the first detachable component contains another stop knot made in the rope. At least one magnet further comprises an aperture and the rope passes through the aperture in said magnet.

Figure 5:
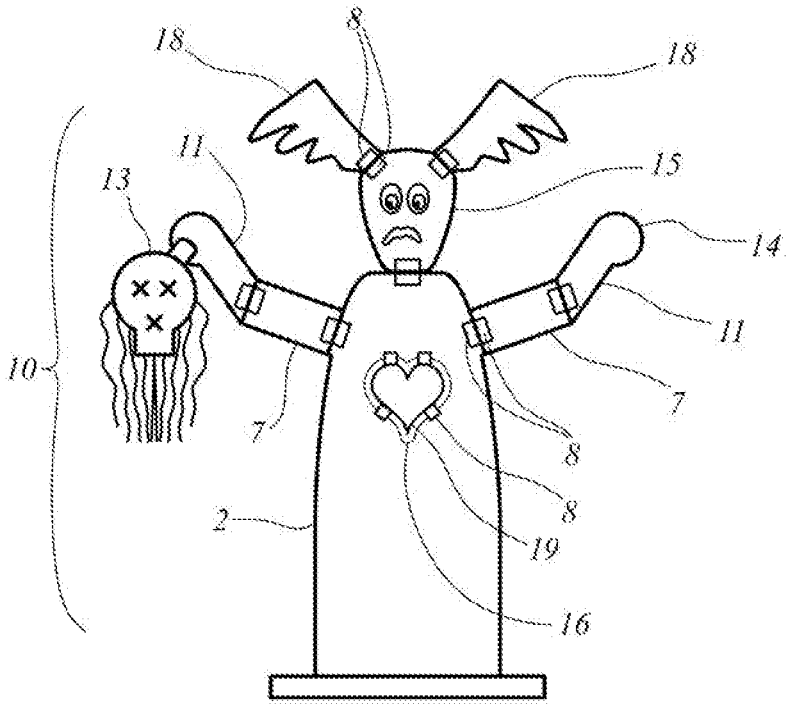
FIG. 5 shows an alternative embodiment of a dismemberable target assembly in accordance with the invention having both linear and branching arrays of detachable components.

FIG. 5 shows an alternative embodiment of a dismemberable target assembly [10] in accordance with the invention, having both linear and branching arrays of detachable components. In this figure, magnetically attached components are also connected by ropes, but in an assembled condition as shown these ropes would reside within the detachable components and not be visible.

As described previously, if the ropes connecting one component to another including, for example, a rope connected from an attachment point on the main body to a first detachable component, reside in internal cavities of the components and pass through apertures thereof, then knots in the rope ends may retain dismembered components so that they dangling closely to their original positions, but are not allowed to touch the ground. The material around the apertures may be selected to resist a knot from pulling through so that the weight of dangling component and embedded projectiles is less than a tensile fore required to pull a knot through such an aperture, but also selected to elastically deform repeatedly without degrading so that a higher extraction or insertion force may pull a knotted rope past the constriction formed by the aperture. In this manner, components may be pulled apart and rearranged. For example a user may install a head coming out an armpit, a foot coming out of a neck, and a forearm extending off a thigh, and create many other unusual and entertaining combinations and arrangements. The length of the rope from a stop knot to a dismemberable component may preferably be adjusted so that a length of the rope spanning between the main body and the first detachable component is shorter than the distance from the attachment point of the detachable component and the bottom of the main body.

Not all components need to include magnets; a magnet in a forearm may attract to and hold a metal part which itself has attractable materials which themselves are not magnets. Components having only attractable metals in them are usually the last or most distal element of an array of components attached to a core component. In a branching array, components having more than one magnetic site on them may be assembled into multiple alternatives of entertaining arrangements. In this figure a head [15] affixed to a main body [2] has two distal sites where wings may be affixed. The ropes used to keep separated components from hitting the ground are not shown in this figure. The arm holding a ghoulish, severed head is an example of a linear array of detachable components. That array includes an upper arm [7] which is a first detachable component, magnetically attached to a forearm [11] which is a second detachable component and which includes a hand portion. The arm components and the main body include magnets [8] defining attachment sites, but the ghoul head may be include a ferrous metal or any other material attractable by magnetism while not having its own magnets. The other arm is another linear array of detachable components terminating with a detachable hand or a depiction of a held object [14] such as a brandished weapon which may be shot out of the hand by a shooter.

In this type of embodiment, the main body also includes an aperture [16] passing through it with one or more magnets along the periphery of the aperture. Another central detachable component [19] may be positioned in the hole and held in place by the one or more magnets. In the embodiment shown, the central detachable component is a heart and a shooter may "shoot the heart out" of the target. The heart may be a metal part or a part having metal portions for magnets [8] to grab and retain.

Although a dismemberable target assembly may comprise connected and assembled segments representing a single creature, other embodiments within the scope of the invention include sets of components representing stacks or groups of animals or a set of related creatures, and the elements of the stack or set may be either picked off sequentially, or alternatively, a component near the base or main body or core of the assembly may be hit so as to topple the rest of the component members distal from the core. A single shot may thus score more than one dislodged components.

In another specific example, an arrangement could include a squirrel held in place atop a deer by one or more magnets so that it could be shot off and reattached to the top of the deer. A rope attached between the squirrel and the deer prevents the squirrel from hitting the ground, and an arrow stuck in the squirrel would be protected from having its fletches damaged as described previously.

Figure 6:
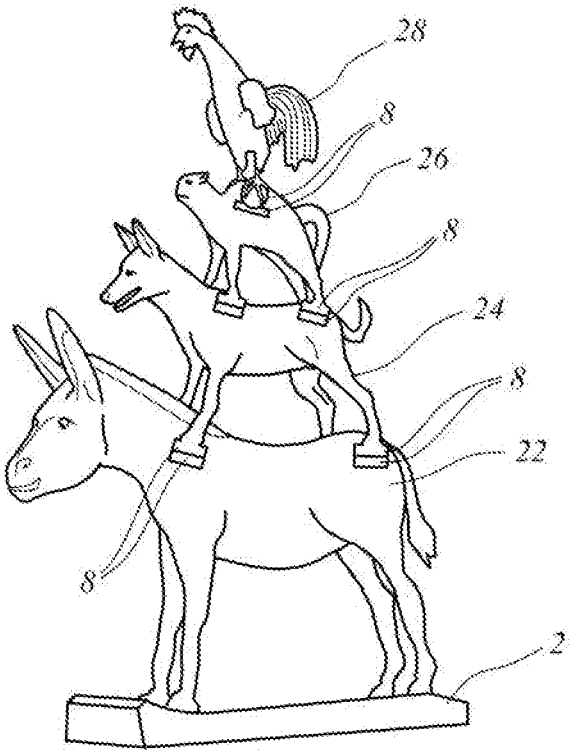
FIG. 6 shows an embodiment of a stacked-creature target assembly in accordance with the invention.

FIG. 6 shows an alternative embodiment of a stacked-creature target assembly in accordance with the invention. This set of animals is collected from one of Grimms' fairytales and includes a base [2] stood upon by an ass or donkey [22.] Magnets may also be included in the feet of the donkey hold it in position un till it is struck hard enough by some-thing so that it may topple over from the base. A dog [24,] a cat [26,] and a rooster [28] perch upon each other in a stack, with magnets [8] in the feet of these animals aligning with other magnets [8] in the backs of the animals. At each interface a pair of magnets may be used, or a magnet may be used in one component and a material attractable by magnetism may be used at a complementary site on another component so that the collection of animals may be magnetically stacked. An attractable or an attracted material for a magnet to attract may also itself be a magnet. A magnetic attachment site is a site on a main body or a detachable component where a material attractable by magnetism is deposed.

In summary, the three advantages of magnetically attached target members which are attached to a core by a rope are: (1) detached target members remain in the vicinity of the assembly, (2) a dangling component which has taken an arrow reduced the chance of the fletches of the arrow being damaged, and (3) a dangling component may resemble and represent a degraded enemy character, which as a reactive target may be more entertaining to a shooter than a static graphics of conventional targets.

Unlike skeet shooting or bottles arrayed on a shelf, where a single hit removes a target from further play, the inventive target is incrementally "degraded" by individual hits, and a sport player may enjoy the accumulative attrition of the target, much like the sense of achievement in pegging the fifth and final hole in a toy aircraft carrier in the game of 'Battleships.' (U.S. Pat. No. 1,988,301 to Coffin.)

Thus two or more players may each use a target and compete on time or number of shots required to adequately strike and detach all available dismemberable target members, if individual point scores are assigned to each dismemberable target member, they may compete on achieving a higher score, either within a limited time or a limited number of projectiles, or they may compete on whoever surpasses a threshold score first.

The sizes and magnetic strengths of magnets for use to build the components of the target assembly may be selected so that a certain minimum ballistic energy must be absorbed into a component by a projectile hit in order to separate a magnet in a first component far enough from a magnet or an attracted material in a second component so that the magnetic attractive force at that distance is weaker than gravitational force, at which point the second component falls clear and is said to be "dismembered" from the first. Weaker hits for glancing blows may fail to separate one component from another, which may become part of a shooting or scoring game in which not only accuracy is required but sufficient force applied to the target is required as an additional criterion for separation.

While certain features and aspects have been described with respect to exemplary embodiments, one skilled in the art will recognize that numerous modifications are possible. Further, while various methods and processes described herein may be described with respect to particular structural and/or functional components for ease of description, methods provided by various embodiments are not limited to any particular structural and/or functional architecture.

Hence, while various embodiments are described with or without certain features for ease of description and to illustrate exemplary aspects of those embodiments, the various components and/or features described herein with respect to a particular embodiment may be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A dismemberable target assembly comprising:

a main body having a bottom and comprising a plurality of magnets defining attachment sites, and a first aperture communicating with a first internal cavity, at least a first detachable component comprising a material attractable by magnetism, a rope having a first stop knot at a first end, said rope spanning between said main body and said first detachable component, and being shorter than a distance from said first aperture to said bottom of said main body, said rope passing through said first aperture of said main body, and said first stop knot extractably received within said first internal cavity of said main body.

2. The dismemberable target assembly of claim 1, further comprising a second detachable component comprising a material attractable by magnetism.

3. The dismemberable target assembly of claim 2, wherein said second detachable component further comprises a magnet.

4. The dismemberable target assembly of claim 2, wherein said second detachable component further comprises at least two magnets and said material attractable by magnetism.

5. The dismemberable target assembly of B claim 1, wherein a material in a vicinity of said first aperture is an elastic material.

6. The dismemberable target assembly of claim 5, further comprising a central detachable component positioned in another aperture in said main body and held in place by at least one magnet.

7. The dismemberable target assembly of claim 1, with said first detachable component further comprising a second aperture communicating with a second internal cavity, said rope passing through said second aperture of said first detachable component, and with said rope having at a second end a second stop knot received within said second internal cavity of said first detachable component.

8. The dismemberable target assembly of claim 7, wherein a material in a vicinity of said second aperture is an elastic material.

9. The dismemberable target assembly of claim 7, wherein a diameter of said first aperture of said main body is larger than a diameter of said rope and a diameter of said first stop knot is larger than said diameter of said first aperture of said main body.

10. The dismemberable target assembly of claim 7, wherein a diameter of said second aperture of said first detachable component is larger than a diameter of said rope and a diameter of said second stop knot is larger than said diameter of said second aperture of said first detachable component.

11. The dismemberable target assembly of claim 7, wherein any one magnet from among said plurality of magnets further comprises an aperture and said rope passes through said aperture in said magnet.

* * * * *